US007708061B2

(12) United States Patent
McGuire et al.

(10) Patent No.: US 7,708,061 B2
(45) **Date of Patent: *May 4, 2010**

(54) CUP TOOL, CUP TOOL CUP AND METHOD OF USING THE CUP TOOL

(75) Inventors: Bob McGuire, Oklahoma City, OK (US); Danny Lee Artherholt, Asher, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 274 days.

This patent is subject to a terminal disclaimer.

(21) Appl. No.: 11/782,377

(22) Filed: Jul. 24, 2007

(65) Prior Publication Data

US 2008/0011489 A1 Jan. 17, 2008

Related U.S. Application Data

(63) Continuation-in-part of application No. 10/979,414, filed on Nov. 2, 2004, now Pat. No. 7,278,477.

(51) Int. Cl.
*E21B 33/12* (2006.01)

(52) U.S. Cl. ..... 166/202; 285/110

(58) Field of Classification Search ..... 166/202, 166/387; 285/110, 332, 350
See application file for complete search history.

(56) References Cited

U.S. PATENT DOCUMENTS

| | | | | |
|---|---|---|---|---|
| 2,664,952 | A | 1/1954 | Losey | 277/335 |
| 2,723,721 | A | 11/1955 | Corsette | 166/179 |
| 2,767,795 | A | 10/1956 | Bush | 166/204 |
| 2,927,643 | A | 3/1960 | Dellinger | 166/75 |
| 2,992,841 | A | 7/1961 | Steinberger | 286/7 |
| 3,100,015 | A | 8/1963 | Regan | 166/378 |
| 3,177,942 | A | 4/1965 | Haeber | 166/359 |
| 3,830,304 | A | 8/1974 | Cummins | 166/305 |
| 4,023,814 | A | 5/1977 | Pitts | 277/181 |
| 4,111,261 | A | 9/1978 | Oliver | 166/90.1 |
| 4,152,924 | A | 5/1979 | Mayo | 73/40.5 |
| 4,241,786 | A | 12/1980 | Bullen | 166/77 |
| 4,315,543 | A | 2/1982 | Luers et al. | 166/202 |

(Continued)

FOREIGN PATENT DOCUMENTS

| | | |
|---|---|---|
| CA | 1272684 | 8/1990 |

(Continued)

*Primary Examiner*—Daniel P Stephenson
(74) *Attorney, Agent, or Firm*—Nelson Mullins Riley & Scarborough, LLP

(57) ABSTRACT

A cup tool includes a cup tool tube having a threaded upper end for connection to a high-pressure mandrel, an outer surface over which an elastomeric cup is slidably mounted for reciprocal movement from an unset position for entry into a wellbore to a set position in which an annular gap is obstructed to contain fluid pressure below the elastomeric cup. The outer surface of the cup tool tube has a lower region of a first diameter and an upper region with a second, larger diameter and a tapered region between the upper region and the lower region. The elastomeric cup includes a lip seal that rides against the outer surface of the cup tool tube, and seals against the tapered region of the cup tool tube to provide a high pressure seal between the cup tool tube and the elastomeric cup in the set position.

20 Claims, 8 Drawing Sheets

U.S. PATENT DOCUMENTS

| | | | | |
|---|---|---|---|---|
| 4,601,494 | A | 7/1986 | McLeod et al. | 285/110 |
| 4,632,183 | A | 12/1986 | McLeod | 166/77 |
| 4,657,075 | A | 4/1987 | McLeod | 166/72 |
| 4,867,243 | A | 9/1989 | Garner et al. | 66/379 |
| 4,961,465 | A | 10/1990 | Brandell | 166/184 |
| 4,993,489 | A | 2/1991 | McLeod | 166/72 |
| 5,012,865 | A | 5/1991 | McLeod | 166/90 |
| 5,020,592 | A | 6/1991 | Muller | 166/187 |
| 5,060,723 | A | 10/1991 | Sutherland et al. | 166/202 |
| 5,103,900 | A | 4/1992 | McLeod et al. | 166/88 |
| 5,261,487 | A | 11/1993 | McLeod et al. | 166/77 |
| 5,396,956 | A | 3/1995 | Cherewyk et al. | 166/250 |
| 5,975,211 | A | 11/1999 | Harris | 166/379 |
| 6,145,596 | A | 11/2000 | Dallas | 166/379 |
| 6,220,363 | B1 | 4/2001 | Dallas | 166/382 |
| 6,247,537 | B1 | 6/2001 | Dallas | 166/379 |
| 6,289,993 | B1 | 9/2001 | Dallas | 166/386 |
| 6,470,965 | B1 | 10/2002 | Winzer | 166/74.4 |
| 6,557,629 | B2 | 5/2003 | Wong | 166/76.1 |
| 6,571,876 | B2 | 6/2003 | Szarka | 166/325 |
| 6,626,245 | B1 | 9/2003 | Dallas | 166/379 |
| 6,666,266 | B2 | 12/2003 | Starr | 166/90.1 |
| 6,769,489 | B2 | 8/2004 | Dallas | 166/386 |
| 6,817,421 | B2 | 11/2004 | Dallas | 166/379 |
| 6,840,328 | B2 | 1/2005 | McKee et al. | 166/387 |
| 6,918,441 | B2 | 7/2005 | Dallas | 166/202 |
| 7,159,663 | B2 | 1/2007 | McGuire et al. | 166/379 |
| 7,207,384 | B2 | 4/2007 | Dallas et al. | 166/250.07 |
| 7,278,477 | B2 * | 10/2007 | McGuire et al. | 166/202 |
| 2006/0151182 | A1 | 7/2006 | Slack | 166/387 |

FOREIGN PATENT DOCUMENTS

| | | |
|---|---|---|
| CA | 2526615 | 5/2006 |
| EP | 0372594 B1 | 10/1989 |

* cited by examiner

CUP TOOL, CUP TOOL CUP AND METHOD OF USING THE CUP TOOL

CROSS-REFERENCE TO RELATED APPLICATIONS

This application is a continuation-in-part of U.S. patent application Ser. No. 10/979,414 filed Nov. 2, 2004.

MICROFICHE APPENDIX

Not applicable.

FIELD OF THE INVENTION

This invention generally relates to wellhead isolation equipment and, in particular, to a cup tool for use with wellhead isolation equipment.

BACKGROUND OF THE INVENTION

Most oil and gas wells require stimulation to enhance hydrocarbon flow to make or keep them economically viable. The servicing of oil and gas wells to stimulate production requires the pumping of fluids into the well under high pressure. The fluids are generally corrosive and/or abrasive because they are laden with corrosive acids and/or abrasive proppants.

In order to protect components that make up the wellhead, such as the valves, tubing hanger, casing hanger, casing head and blowout preventer equipment, wellhead isolation equipment, such as a wellhead isolation tool, a casing saver or a blowout preventer protector is used during well fracturing and well stimulation procedures. The wellhead isolation equipment generally includes a high pressure mandrel that is inserted through wellhead components to isolate the wellhead components from elevated fluid pressures and from the corrosive/abrasive fluids used in the well treatment to stimulate production. A sealing mechanism, generally referred to as a sealing nipple or a cup tool, connected to a bottom of the high pressure mandrel is used to isolate the wellhead components from high fluid pressures used for well stimulation treatments.

Various sealing mechanisms provided for wellhead isolation equipment are described in prior art patents, such as U.S. Pat. No. 4,023,814, entitled A TREE SAVER PACKER CUP, which issued to Pitts on May 17, 1977; U.S. Pat. No. 4,111,261, entitled A WELLHEAD ISOLATION TOOL, which issued to Oliver on Sep. 5, 1978; U.S. Pat. No. 4,601,494, entitled A NIPPLE INSERT, which issued to McLeod et al. on Jul. 22, 1986; Canadian Patent 1,272,684, entitled A WELLHEAD ISOLATION TOOL NIPPLE, which issued to Sutherland-Wenger on Aug. 14, 1990; U.S. Pat. No. 5,261,487 entitled PACKOFF NIPPLE, which issued to McLeod et al. on Nov. 16, 1993; and Applicant's U.S. Pat. No. 6,918,441 entitled CUP TOOL FOR HIGH PRESSURE MANDREL, which issued Jul. 19, 2005. These sealing mechanisms include an elastomeric cup that radially expands under high fluid pressures to seal against an inside wall of a production tubing or casing.

The elastomeric cups are commonly bonded to a steel ring, sleeve or mandrel. In the most common construction, the two-part elastomeric cup is bonded to a steel ring that sides over a cup tool tube, also referred to as a cup tool mandrel. An O-ring seal carried by the steel ring provides a fluid seal between the two-part elastomeric cup and the cup tool tube.

In spite of all the known cup tools, there still exists a need for an improved cup tool that is simple and inexpensive to manufacture and provides a reliable seal at very high fluid pressures.

SUMMARY OF THE INVENTION

It is therefore an object of the invention to provide a cup tool that is simple and inexpensive to manufacture and provides a reliable seal at very high fluid pressures.

The invention therefore provides a cup tool for providing a high-pressure fluid-tight seal in an annular gap between the cup tool and a casing or a tubing in a cased wellbore, the cup tool comprising: a cup tool tube having a threaded upper end for connection to a high-pressure mandrel, the cup tool tube having an outer surface over which a two-part elastomeric cup is slidably mounted for reciprocal movement from an unset position for entry of the cup tool into the wellbore to a set position in which the annular gap is obstructed by a top part of the two-part elastomeric cup to contain fluid pressure below the two-part elastomeric cup, the outer surface of the cup tool tube having a lower region of a first diameter and an upper region with a second, larger diameter and a tapered region between the upper region and the lower region; and the two-part elastomeric cup including a bottom part having a lip seal that rides against the outer surface of the cup tool tube, and seals against the tapered region of the cup tool tube to provide a high pressure seal between the cup tool tube and the bottom part of the two-part elastomeric cup when the two-part elastomeric cup is in the set position.

The invention further provides a cup tool for providing a high-pressure fluid-tight seal in an annular gap between the cup tool and a tubing or casing in a cased wellbore, the cup tool comprising: a cup tool tube having a threaded upper end for connection to a high-pressure mandrel, the cup tool tube having an outer surface over which a two-part elastomeric cup is slidably mounted for reciprocal movement from an unset position for entry of the cup tool into the wellbore to a set position in which the annular gap is obstructed by a top part of the two-part elastomeric cup to contain fluid pressure below the two-part elastomeric cup, the outer surface of the cup tool tube having a lower region of a first diameter and an upper region of a second, larger diameter and a tapered region between the upper region and the lower region; and a bottom part of the two-part elastomeric cup including a lip seal that rides against the outer surface of the cup tool tube and seals against the tapered region of the cup tool tube to provide a high pressure seal between the cup tool tube and the bottom part of the two-part elastomeric cup when the top part of the two-part elastomeric cup is in the set position.

The invention yet further provides a cup for a cup tool that provides a high-pressure fluid-tight seal in an annular gap between the cup tool and one of a cased wellbore and an inner wall of a tubing suspended in a cased wellbore, the cup comprising: a hollow generally tubular two-part elastomeric body having an outer wall and an inner wall, the outer wall of a bottom part of the two-part elastomeric body extending downwardly past the inner wall and terminating on a bottom end in an annular depending skirt, and the inner wall of the bottom part including a lip seal that rides against an outer surface of a cup tool tube, and seals against a tapered region of the cup tool tube to provide a high pressure seal between the cup tool tube and the bottom part of the two-part elastomeric cup when the two-part elastomeric cup is in a set position in which a top part of the two-part elastomeric body seals the annular gap.

The invention still further provides a method of sealing an annular gap between a high pressure mandrel and a casing or a tubing in a cased wellbore in order to isolate pressure-sensitive wellhead components from high-pressure fracturing and stimulation operations in a well, the method comprising: connecting a cup tool tube to a bottom end of the high-pressure mandrel, the cup tool tube having an outer surface over which a two-part elastomeric cup is slidably mounted for reciprocal movement from an unset position for entry of the cup tool into the wellbore to a set position in which the annular gap is obstructed by a top part of the two-part elastomeric cup to contain fluid pressure below the two-part elastomeric cup, the outer surface of the cup tool tube having a lower region of a first diameter and an upper region of a second, larger diameter and a tapered region between the upper region and the lower region; sliding the top part and a bottom part of a two-part elastomeric cup over the cup tool tube, the bottom part including a lip seal that rides against the outer surface of the cup tool tube, and seals against the tapered region of the cup tool tube to provide a high pressure seal between the cup tool tube and the bottom part of the two-part elastomeric cup when the two-part elastomeric cup is in the set position; connecting a bullnose to a bottom end of the cup tool tube; inserting the cup tool into the casing or the tubing in the cased wellbore; and injecting high pressure fluids through the high pressure mandrel and the cup tool into the wellbore to force the two-part elastomeric cup upwardly and the top part against a shoulder at a top of the cup tool tube, thereby forcing the lip seal against the tapered region, while forcing the top part of the two-part elastomeric cup into the set position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

In general, as will be explained below, the invention provides a cup tool for providing a high-pressure fluid seal in an annular gap between a high-pressure mandrel and a casing or a production tubing in a wellbore. The cup tool includes a cup tool tube having a threaded upper end for connection to the high-pressure mandrel, an elastomeric cup that is slidably received on a cup tool tube. A top end of the elastomeric cup is forced upwardly and over an annular shoulder at the top to the cup tool tube to a set position when the cup is exposed to elevated fluid pressures, thereby extruding into the annular gap to provide the high-pressure fluid seal. In the set position, a lip seal on an internal surface of the cup sealingly engages a tapered external surface of the cup tool tube to provide a high-pressure fluid-tight seal between the elastomeric cup and the cup tool tube. A bullnose, or the like, is threadedly fitted to a bottom of the cup tool tube to protect the cup while guiding the cup tool through a wellhead.

Figure 1:
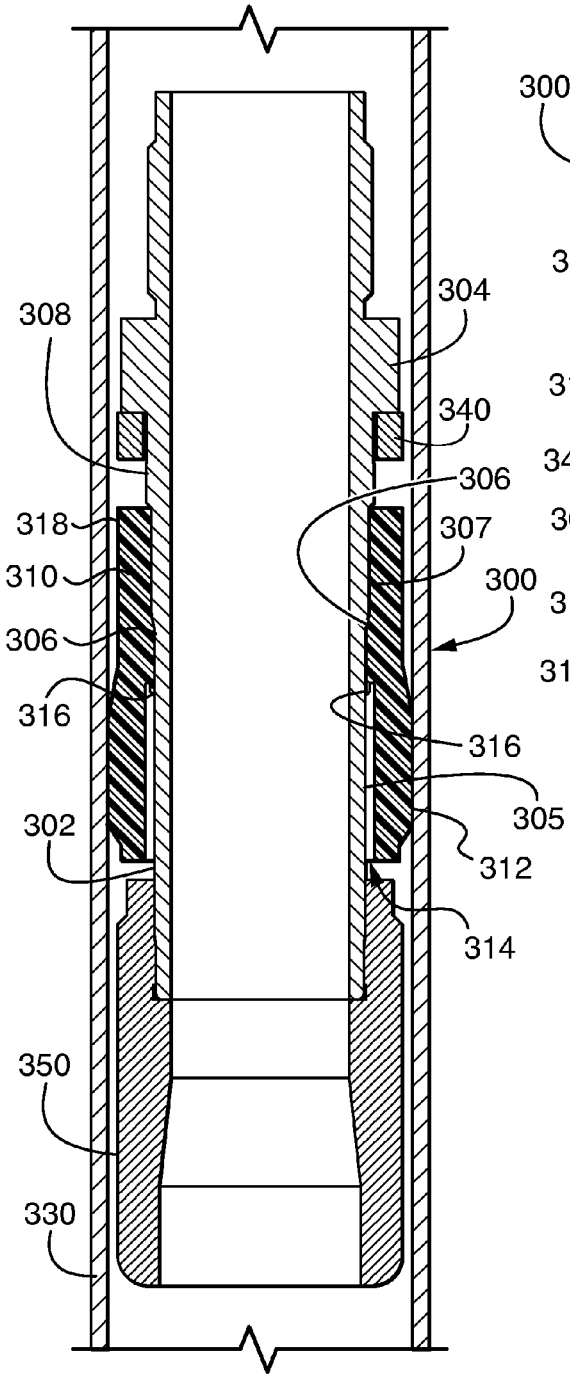
FIG. 1 is a schematic cross-sectional view of a cup tool in accordance with one embodiment of the invention prior to setting an two-part elastomeric cup of the cup tool.

As shown in FIG. 1, a cup tool 300, in accordance with one embodiment of the invention, includes a cup tool tube 302 (also known as a cup tool mandrel). The cup tool tube 302 includes an annular shoulder 304 at a threaded upper end for connection to the high-pressure mandrel (not shown). The cup tool tube also has an external surface with a lower portion 305 of a first diameter, an upper portion 307 of a second, larger diameter and a tapered portion 306 between the first and second regions, the utility of which will be described below. The cup tool further includes an annular abutment 308 with a radius slightly larger than that of the cup tool tube 302.

The cup tool 300 connects to the high-pressure mandrel to form a lower end of a wellhead isolation tool, casing saver or blowout preventer protector for isolating pressure-sensitive wellhead components from the deleterious affects of high-pressure fracturing and stimulation fluids. In order to isolate the pressure-sensitive wellhead components, the cup tool includes an elastomeric cup 310 for sealing off an annular gap 320 between the cup tool 300 and a tubing 330, which may be a casing in a cased wellbore or a production tubing in the wellbore. As shown in this embodiment, the elastomeric cup 310 is slidably received on the cup tool tube 302. The elastomeric cup 310 abuts the annular abutment 308 when the cup is in an unset position for entry into the wellbore. The elastomeric cup 310 has a downwardly depending skirt portion 312 which defines an annular cavity 314 between the skirt portion 312 and the cup tool tube 302.

The elastomeric cup 310 also includes a lip seal 316 that protrudes both downwardly and radially inward and rides against an inner surface of the cup tool tube 302. The lip seal 316 seals against the tapered portion 306 of the cup tool tube 302 when the elastomeric cup 310 is forced upwardly by fluid pressure to a set position shown in FIG. 2.

As shown in FIG. 1, an optional gauge ring 340 is located beneath an annular shoulder 304 at a top end of the cup tool tube 302. The gauge ring 340 can be retained on the cup tool tube by frictional or threaded engagement. The gauge ring 340 can be made of metal and machined to provide one or more right-angled steps engaged by the top end of the elastomeric cup 310 to inhibit the elastomeric cup from moving to the set position as it is stroked into the wellbore, while facilitating extrusion of the elastomeric cup 310 into the annular gap when the elastomeric cup 310 is exposed to high fluid pressures. The function of the gauge ring 340 is explained in detail in Applicants' U.S. Pat. No. 6,918,441 which issued Jul. 19, 2005, the specification of which is incorporated herein by reference.

A bullnose 350, or the like, is connected, by threads or other suitable connector, to a bottom end of the cup tool tube 302. The bullnose 350 helps to guide the cup tool through the wellhead and also protects the elastomeric cup 310 during insertion of the cup tool through the wellhead.

In one embodiment, the elastomeric cup 310 is made of polyurethane having a Durometer of 80-100. In another embodiment the elastomeric cup 310 has a Durometer of 90-100. The elastomeric cup can be made of any elastomeric material having a durometer of 80-100, including other polymers, nitrile rubber, carbon reinforced rubbers or polymers, etc. During testing, the fluid-tight seal provided by a cup tool having a polyurethane cup has successfully contained fluid pressures of at least 22,500 psi without loss of seal or damage to the elastomeric cup 310. Accordingly, the cup tool is simple and inexpensive to manufacture and provides a reliable high pressure fluid seal for isolating pressure-sensitive wellhead components during well fracturing and stimulation operations. The cup tool also permits well stimulation to be safely conducted at fluid pressures that approach a pressure rating of the well casing.

Figure 2:
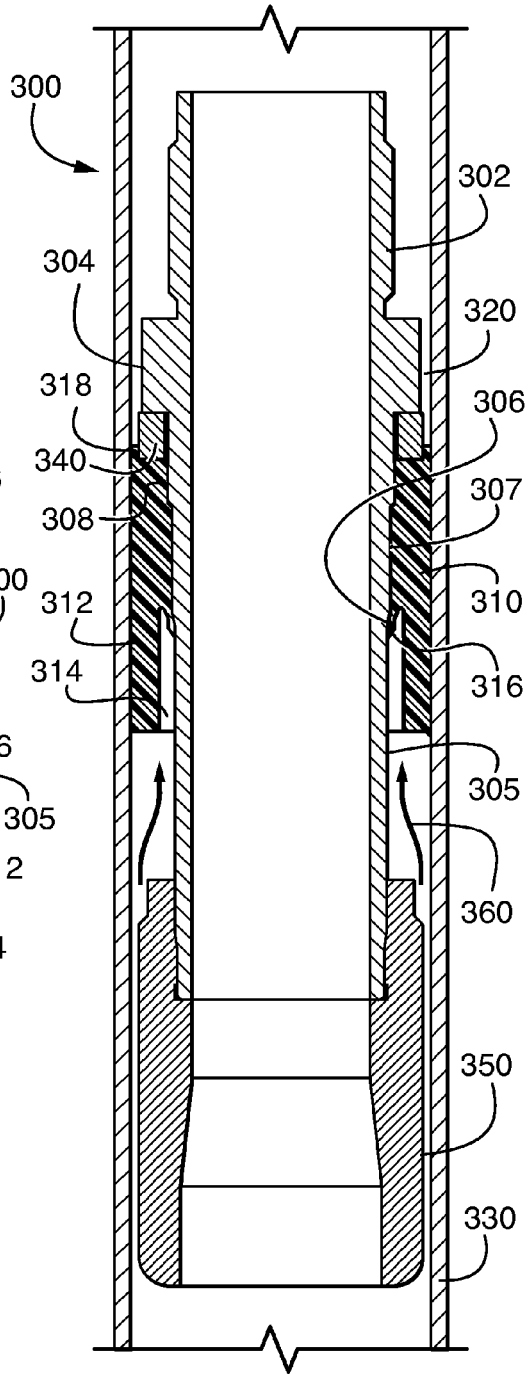
FIG. 2 is a schematic cross-sectional view of the embodiment shown in FIG. 1 subsequent to setting the elastomeric cup.

FIG. 2 illustrates the cup tool with the elastomeric seal in the set position. Fluid pressure 360 in the well causes the elastomeric cup 310 to move both upwardly and radially outwardly (due to pressurization of the annular cavity 314). The skirt portion 312 of the cup presses against the tubing 330 to form a seal therewith. Due to the fluid pressure 360, the cup moves upwardly, extruding over the annular abutment 308, until the lip seal 316 seals against the tapered portion 306 of the cup tool tube 302 and a top portion 318 of the elastomeric cup 310 is forced against the gauge ring 340. Under elevated fluid pressures 360, the top end 318 of the elastomeric cup 310 is extruded into the annular gap 320 between the gauge ring 340 and the tubing 330, thus forming a high-pressure fluid-tight seal between the gauge ring 340 and the tubing 330.

Three other embodiments of the invention are shown in FIGS. 3-8. Most of the components of these three other embodiments are identical to those described above and are not redundantly described below.

Figure 3:
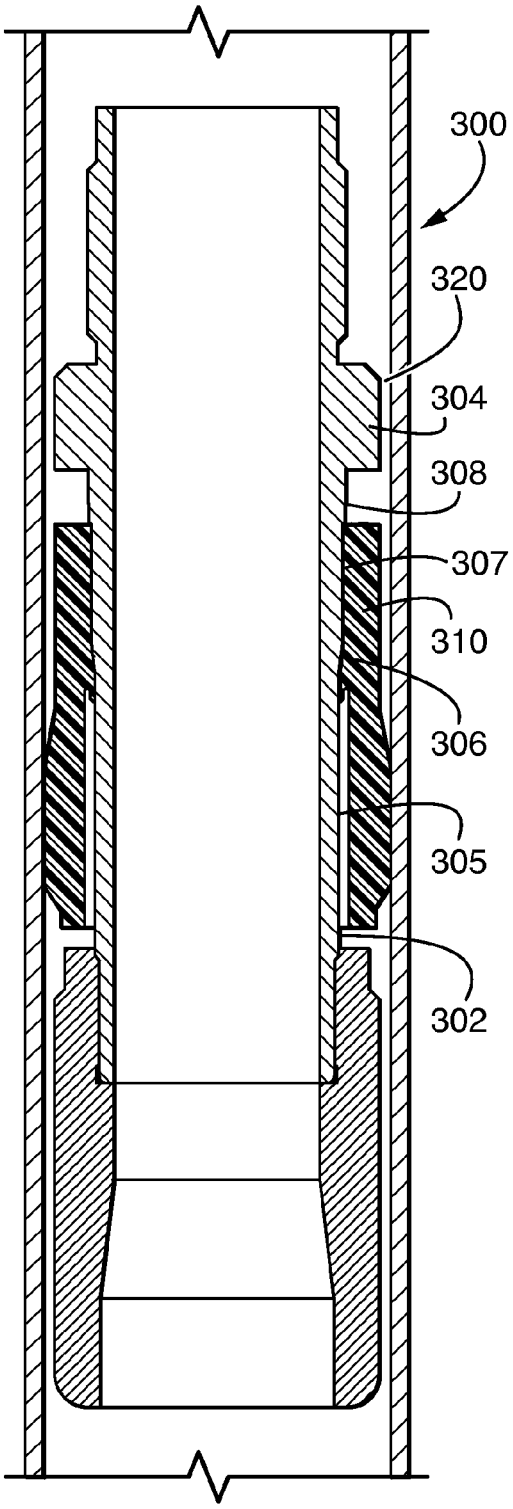
FIG. 3 is a schematic cross-sectional view of a cup tool in accordance with a second embodiment of the invention prior to setting the elastomeric cup.

FIG. 3 shows a cup tool 300 in accordance with another embodiment of the invention, with the elastomeric cup 310 in the unset position. As is apparent from FIG. 3, the cup tool 300 does not have a gauge ring. The cup tool 300 merely has a cup tool tube 302 with an annular shoulder 304 machined to present a right-angled step to the top of the elastomeric cup 310.

Figure 4:
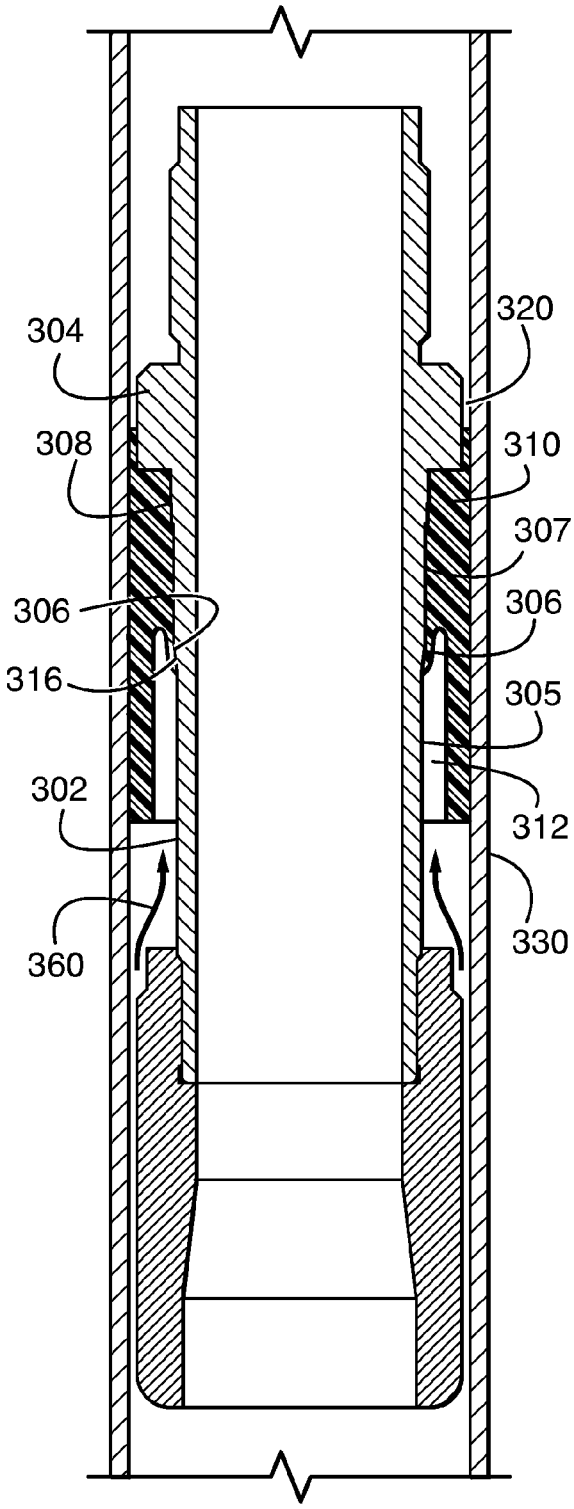
FIG. 4 is a schematic cross-sectional view of the embodiment shown in FIG. 3 subsequent to setting the elastomeric cup.

FIG. 4 shows the cup tool shown in FIG. 3 after the elastomeric cup 310 is forced to the set condition. When exposed to fluid pressure 360, the skirt portion 312 of the elastomeric cup 310 expands outwardly into sealing contact with the inner surface of the tubing 330. The elastomeric cup 310 is forced upwardly, extruding first over the annular abutment 308 and then, if the fluid pressure 360 is sufficiently high, over the annular shoulder 304 into the annular gap 320 to form a fluid-tight seal between the cup tool and the tubing. As the elastomeric cup 310 is forced upwardly, the lip seal 316 comes into engagement with the tapered portion 306 of the cup tool tube 302, and forms a high pressure seal therewith. Setting the elastomeric cup 310 seals the annular gap between the cup tool 300 and the tubing 330, thus isolating the pressure-sensitive wellhead components from the affects of high-pressure fracturing and stimulation fluids in the well.

Figure 5:
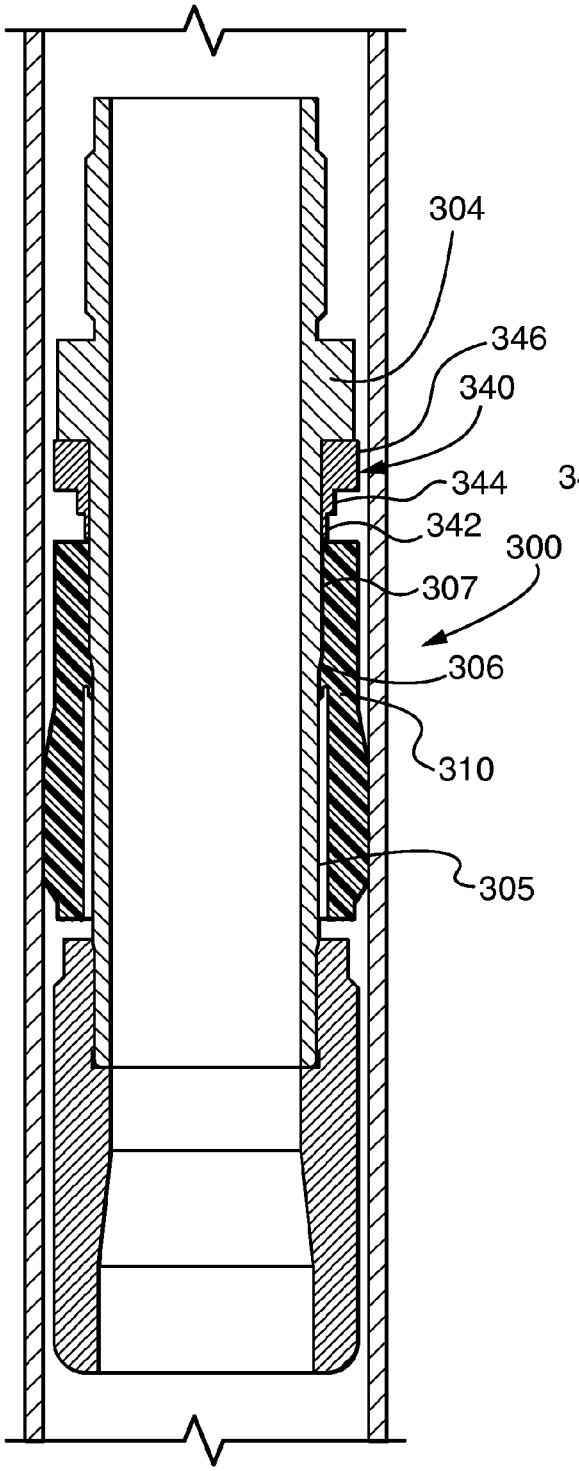
FIG. 5 is a schematic cross-sectional view of a cup tool in accordance with a third embodiment of the invention prior to setting the elastomeric cup.

FIG. 5 shows a cup tool 300 in accordance with another embodiment of the invention. The cup tool 300 includes a gauge ring 340 having three right-angled steps. As was explained above, right-angled steps impede setting of the elastomeric cup 310 as is travels down through the wellhead. As shown in FIG. 5, the gauge ring 340 includes a first step 342, a second step 344 and a third step 346 of increasing radius.

Figure 6:
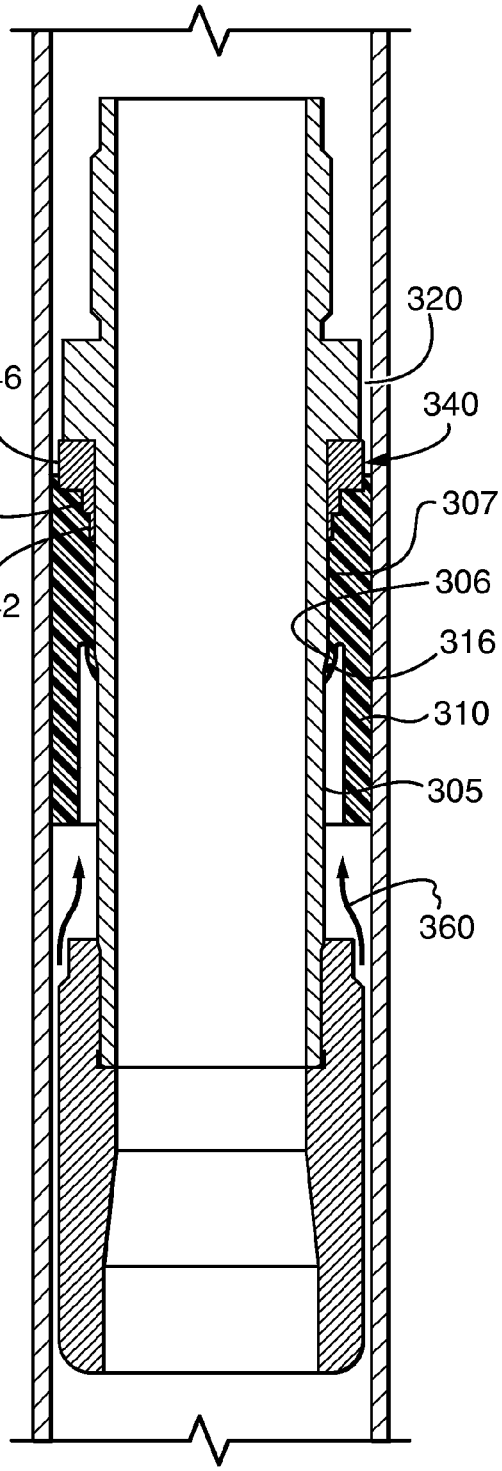
FIG. 6 is a schematic cross-sectional view of the embodiment shown in FIG. 5 subsequent to setting the elastomeric cup.

FIG. 6 shows the cup tool shown in FIG. 5 after the elastomeric cup 310 is set. If fluid pressure 360 in the well rises above a first threshold pressure, the elastomeric cup 310 extrudes over the first step 342. If the fluid pressure is further elevated beyond a second threshold pressure, the elastomeric cup 310 extrudes over the second step 344. If the fluid pressure is further elevated past a third threshold pressure, the elastomeric cup 310 extrudes over the third step 346.

Figure 7:
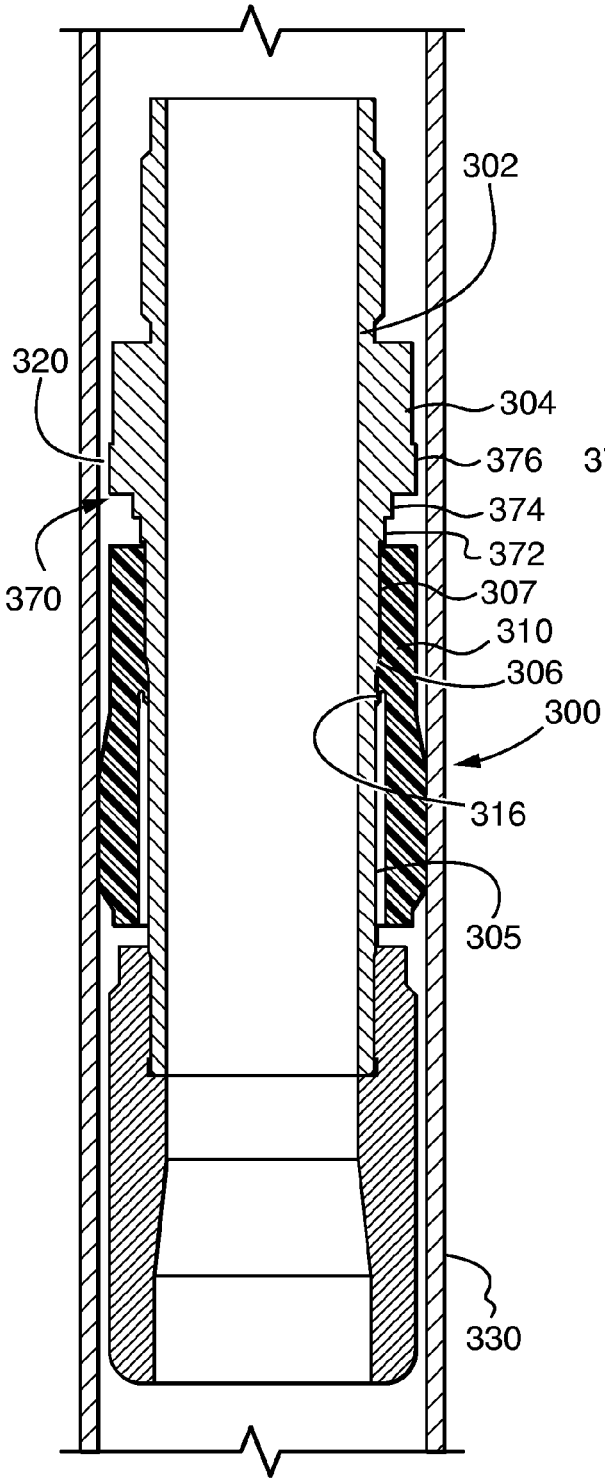
FIG. 7 is a schematic cross-sectional view of a cup tool in accordance with a fourth embodiment of the invention prior to setting the elastomeric cup.

FIG. 7 shows a cup tool 300 in accordance with yet another embodiment of the invention. The cup tool 300 has a cup tool tube 302 with an annular shoulder 304.

Integrally formed with the annular shoulder 304 on the underside thereof is a plurality of square steps 370, which include a first step 372, a second step 374 and a third step 376. The first, second and third steps function in the same way as the gauge rings 340 described above.

Figure 8:
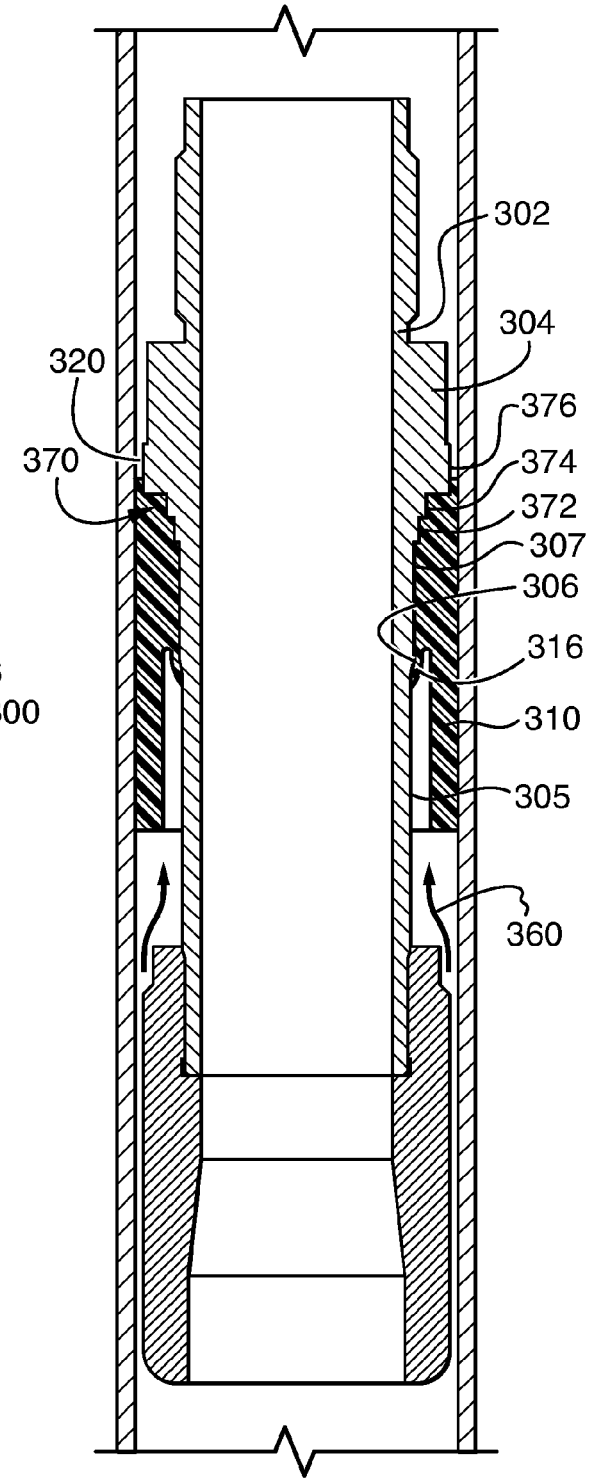
FIG. 8 is a schematic cross-sectional view of the embodiment shown in FIG. 7 subsequent to setting the elastomeric cup.

FIG. 8 shows the cup tool shown in FIG. 7 after the elastomeric cup 310 is set. If fluid pressure 360 in the well rises above a first threshold pressure, the elastomeric cup 310 extrudes over the first step 372. If the fluid pressure is elevated above a second threshold pressure, the elastomeric cup 310 extrudes over the second step 374. If the fluid pressure is further elevated above a third threshold pressure, the elastomeric cup 310 extrudes over the third step 376.

Figure 9:
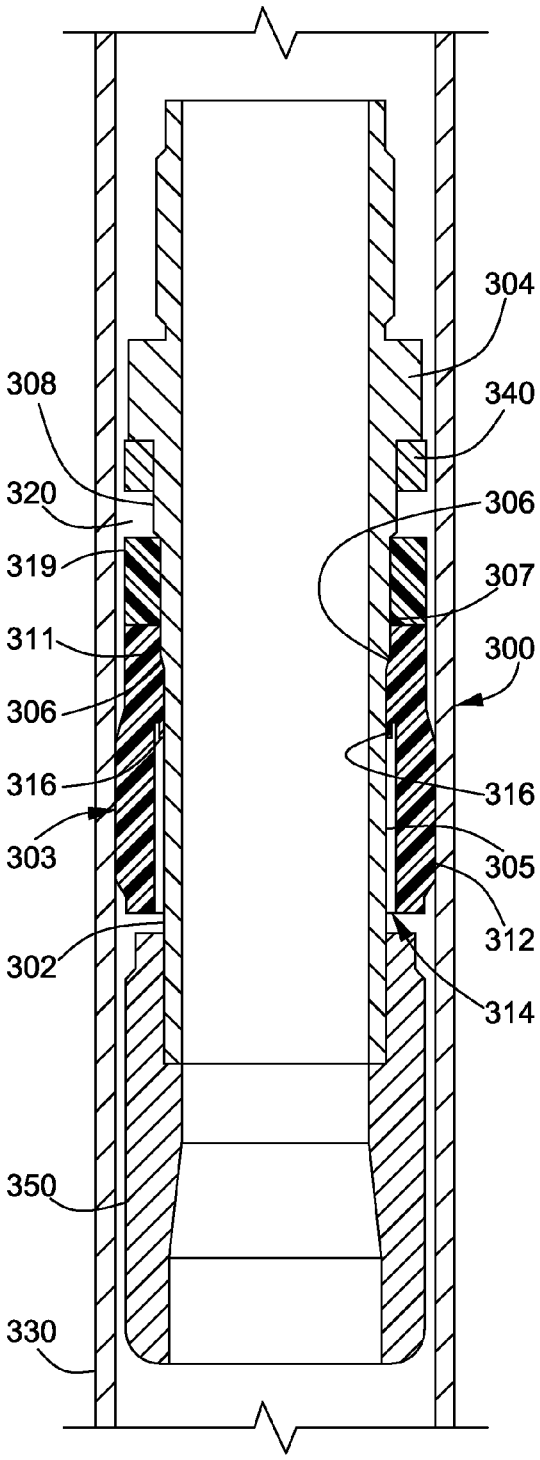
FIG. 9 is a schematic cross-sectional view of a cup tool in accordance with a fifth embodiment of the invention prior to setting an two-part elastomeric cup of the cup tool.

As shown in FIG. 9, the cup tool 300 includes a two-part elastomeric cup 303 having a bottom part 311 for providing a high-pressure seal around the cup tool tube 302 and a top part 319 for sealing off the annular gap 320 between the cup tool 300 and the tubing 330, which as explained above may be a casing in the cased wellbore or the production tubing in the cased wellbore. As shown in this embodiment, the two-part elastomeric cup 303 is slidably received on the cup tool tube 302. The top part 319 of the two-part elastomeric cup 303 abuts the annular abutment 308 when the two-part elastomeric cup 303 is in an unset position for entry into the wellbore. The bottom part 311 of the elastomeric cup 303 has a downwardly depending skirt portion 312 which defines an annular cavity 314 between the skirt portion 312 and the cup tool tube 302.

The bottom part 311 of the two-part elastomeric cup 303 also includes a lip seal 316 that protrudes both downwardly and radially inwardly and rides against an inner surface of the cup tool tube 302. The lip seal 316 seals against the tapered region 306 of the cup tool tube 302 when the two-part elastomeric cup 303 is forced upwardly by fluid pressure to a set position shown in FIG. 10.

In one embodiment, the two-part elastomeric cup 303 is molded as a single piece, and the top part 319 is a parted from the bottom part 311 using a lathe and a parting tool, in a manner well known in the art. It should be understood, however, that the bottom part 311 and the top part 319 could be molded separately. If the bottom part 311 and the top part 319 are molded separately, they may have somewhat different Durometers. It should be noted that the bottom part 311 has a square top edge that meets with a square bottom edge of the top part 319. Thus the two parts 311, 319 are forced upwardly in unison over the cup tool tube 302 from the unset to the set position when the two-part elastomeric cup 303 is exposed to elevated fluid pressure, which may be natural well pressure and/or the fluid pressure induced by well stimulation fluid pumped down the through the cup tool tube. In one embodiment, the top part is about 1¼" (31.8 mm) long. Experimentation has shown that the cup tool 300 performs a well if the top part 319 has a length of between about 1⅛" (28.6 mm) and about 1⅜" (34.9 mm).

As shown in FIG. 9, an optional gauge ring 340 is located beneath an annular shoulder 304 at a top end of the cup tool tube 302. The gauge ring 340 can be retained on the cup tool tube by frictional or threaded engagement. The gauge ring 340 can be made of metal and machined to provide one or more right-angled steps engaged by the top part 319 of the two-part elastomeric cup 303 to inhibit the two-part elastomeric cup 303 from moving to the set position as it is stroked into the casing or tubing, while facilitating extrusion of the top part 319 into the annular gap when the two-part elastomeric cup 303 is exposed to high fluid pressures.

In one embodiment, the two-part elastomeric cup 303 is made of polyurethane having a Durometer of 80-100. In another embodiment each part of the two-part elastomeric cup 303 has a Durometer of 90-100. The two-part elastomeric cup 303 can be made of any elastomeric material having a durometer of 80-100, including other polymers, nitrile rubber, carbon reinforced rubbers or polymers, etc. During testing, the fluid-tight seal provided by a cup tool 300 having a polyurethane cup has successfully contained fluid pressures of at least 22,500 psi without loss of seal or damage to the two-part elastomeric cup 303. Accordingly, the cup tool is simple and inexpensive to manufacture and provides a reliable high pressure fluid seal for isolating pressure-sensitive wellhead components during well fracturing and stimulation operations. The cup tool 300 also permits well stimulation to be safely conducted at fluid pressures that approach a pressure rating of the well casing.

Figure 10:
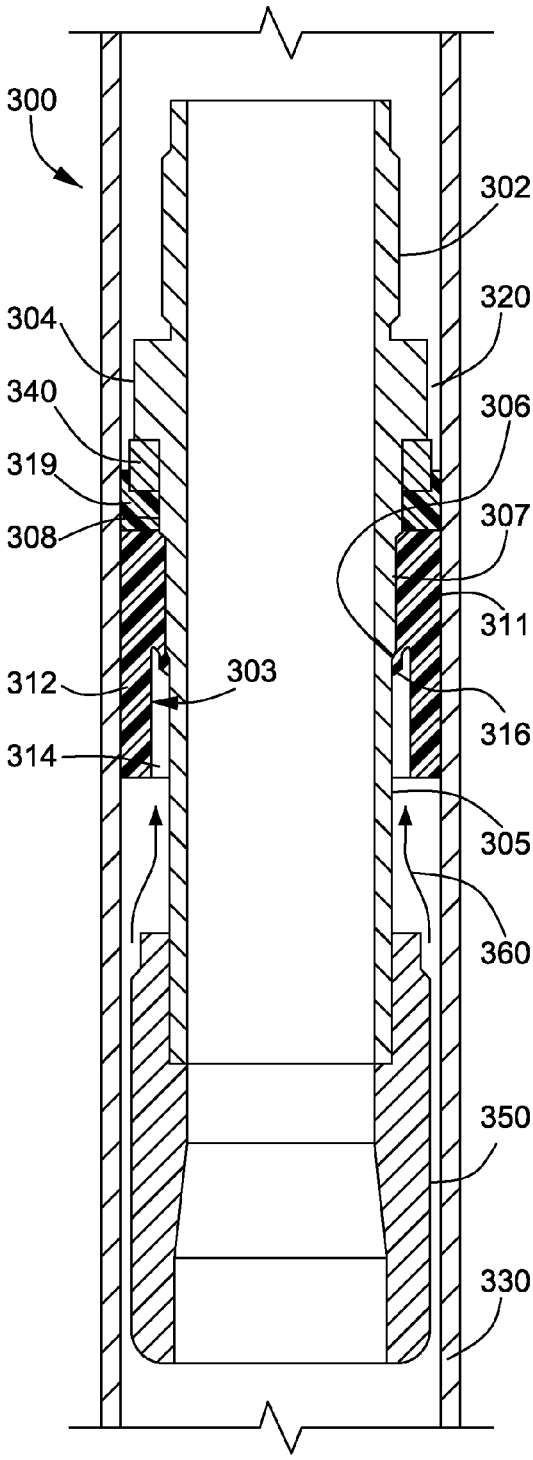
FIG. 10 is a schematic cross-sectional view of the embodiment shown in FIG. 9 subsequent to setting the elastomeric cup.

FIG. 10 illustrates the cup tool 300 with the two-part elastomeric cup 303 in the set position. Fluid pressure 360 in the well causes the two-part elastomeric cup 303 to move upwardly and the top part 319 moves radially outwardly (due to pressurization of the annular cavity 314). The skirt portion 312 of the bottom part 311 presses against the casing or tubing 330 to form a seal therewith. Due to the fluid pressure 360, the two-part elastomeric cup 303 moves upwardly, and the top part 319 extrudes over the annular abutment 308. Meanwhile, the lip seal 316 seals against the tapered portion 306 of the cup tool tube 302 and the top part 319 of the two-part elastomeric cup 303 is forced against the gauge ring 340. Under elevated fluid pressures 360, the top part 319 of the two-part elastomeric cup 303 is extruded into the annular gap 320 between the gauge ring 340 and the tubing 330, thus forming a high-pressure fluid-tight seal between the gauge ring 340 and the casing or tubing 330.

Figure 11:
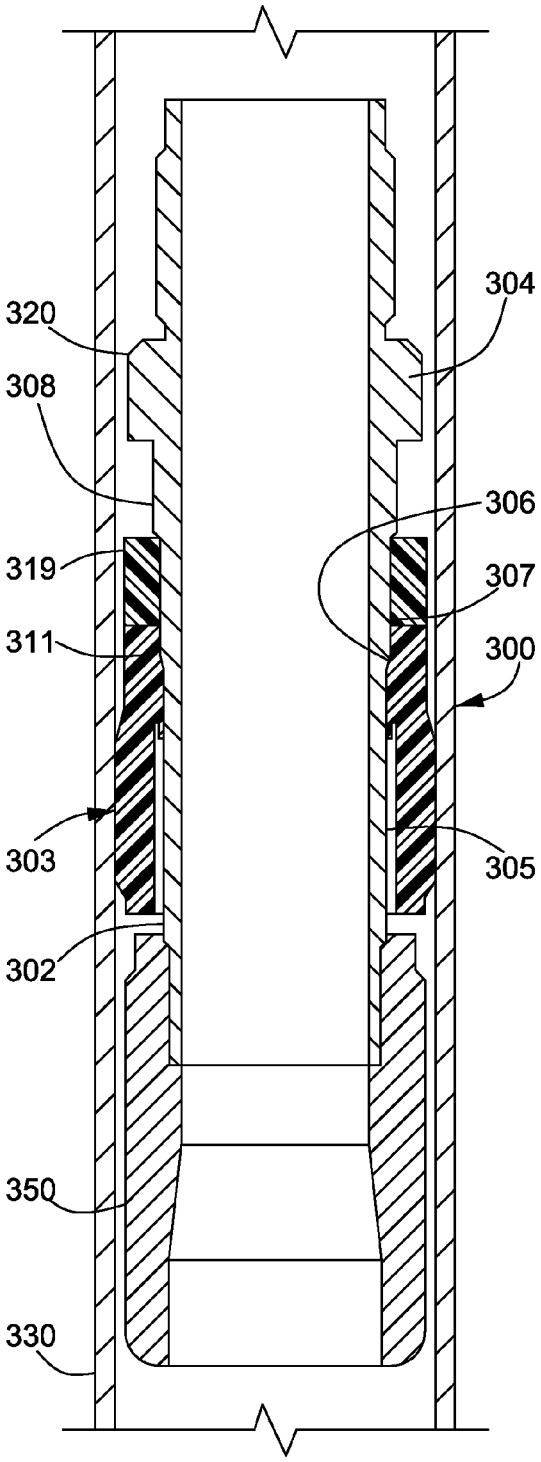
FIG. 11 is a schematic cross-sectional view of a cup tool in accordance with a sixth embodiment of the invention prior to setting the elastomeric cup.

FIG. 11 shows a cup tool 300 in accordance with another embodiment of the invention, with the two-part elastomeric cup 303 in the unset position. As is apparent from FIG. 11, the cup tool 300 does not have a gauge ring. The cup tool 300 merely has a cup tool tube 302 with an annular shoulder 304 machined to present a right-angled step to the top part 319 of the two-part elastomeric cup 303.

Figure 12:
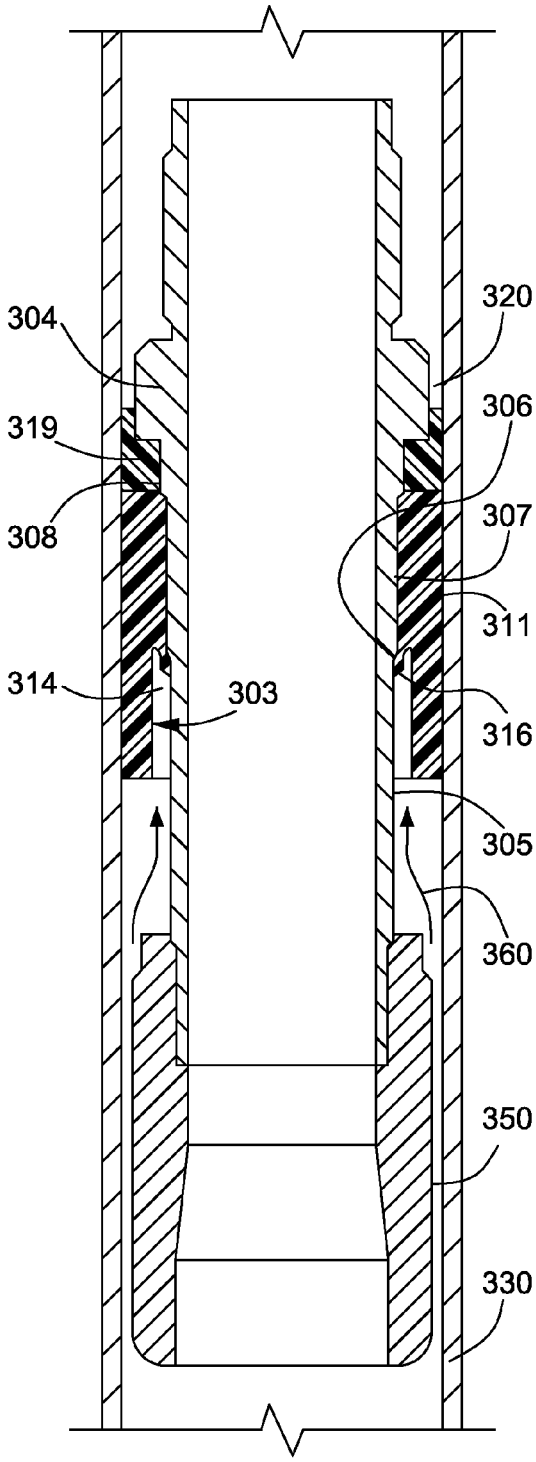
FIG. 12 is a schematic cross-sectional view of the embodiment shown in FIG. 11 subsequent to setting the elastomeric cup.

FIG. 12 shows the cup tool shown in FIG. 11 after the top-part 318 of the two-part elastomeric cup 303 is forced to the set condition. When exposed to fluid pressure 360, the skirt portion 312 of the bottom part 311 of the two-part elastomeric cup 303, which is in sealing contact with the inner surface of the casing or tubing 330, forces the top part 319 of the two-part elastomeric cup 303 upwardly. The top part 319 extrudes first over the annular abutment 308 and then, if the fluid pressure 360 is sufficiently high, over the annular shoulder 304 into the annular gap 320 to form the fluid-tight seal between the cup tool 300 and the casing or tubing. As the two-part elastomeric cup 303 is forced upwardly, the lip seal 316 of the bottom part 311 comes into engagement with the tapered region 306 of the cup tool tube 302, and forms a high pressure seal therewith. Setting the two-part elastomeric cup 303 seals the annular gap between the cup tool 300 and the casing or tubing 330, thus isolating the pressure-sensitive wellhead components from the affects of high-pressure fracturing and stimulation fluids in the well.

Figure 13:
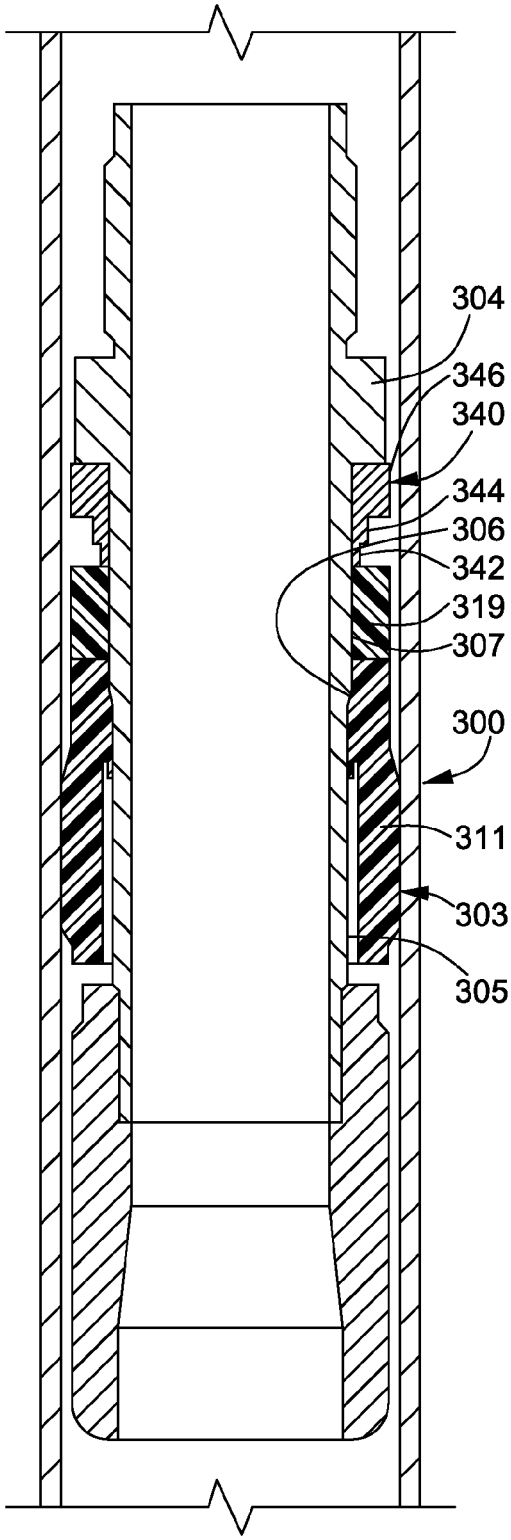
FIG. 13 is a schematic cross-sectional view of a cup tool in accordance with a seventh embodiment of the invention prior to setting the elastomeric cup.

FIG. 13 shows a cup tool 300 in accordance with another embodiment of the invention. The cup tool 300 includes a gauge ring 340 having three right-angled steps. As was explained above, right-angled steps impede setting of the two-part elastomeric cup 303 as is travels down through the wellhead. As shown in FIG. 13, the gauge ring 340 includes a first step 342, a second step 344 and a third step 346 of increasing diameter.

Figure 14:
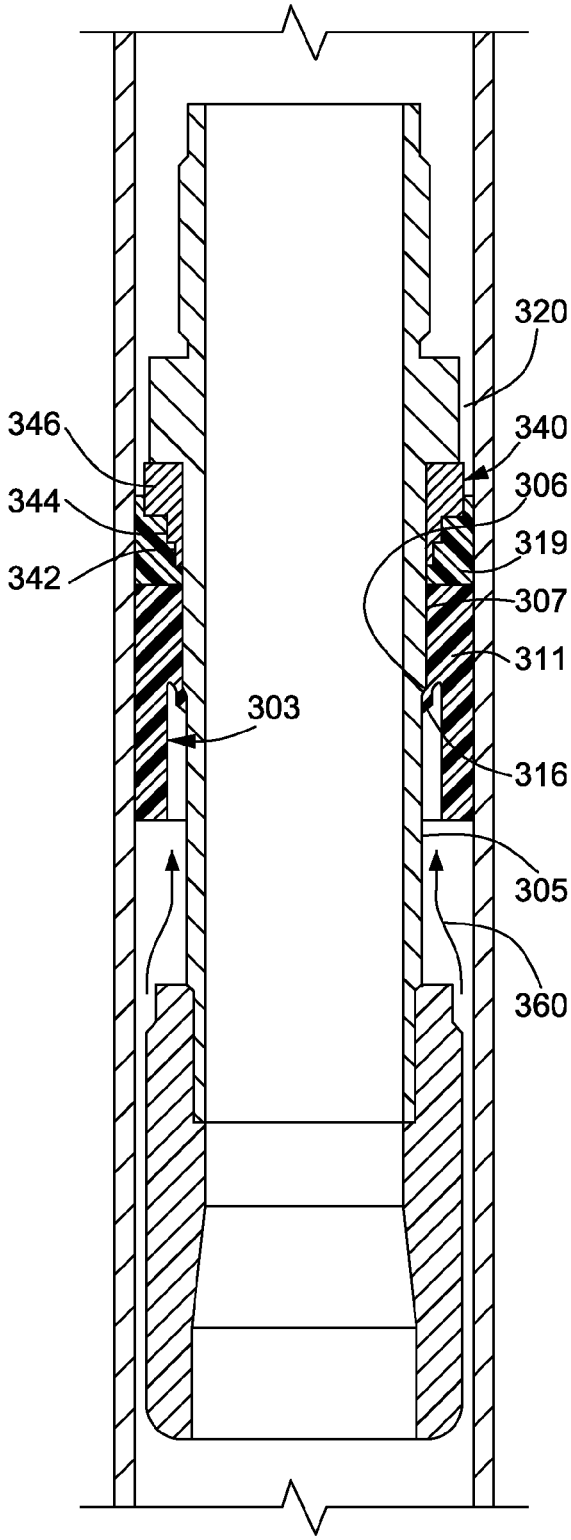
FIG. 14 is a schematic cross-sectional view of the embodiment shown in FIG. 13 subsequent to setting the elastomeric cup.

FIG. 14 shows the cup tool shown in FIG. 13 after the top part 319 of the two-part elastomeric cup 303 is set. If fluid pressure 360 in the well rises above a first threshold pressure, the top part 319 of the two-part elastomeric cup 303 extrudes over the first step 342. If the fluid pressure is further elevated beyond a second threshold pressure, the top part 319 of the two-part elastomeric cup 303 extrudes over the second step 344. If the fluid pressure is further elevated past a third threshold pressure, the top part 319 of the two-part elastomeric cup 303 extrudes over the third step 346.

Figure 15:
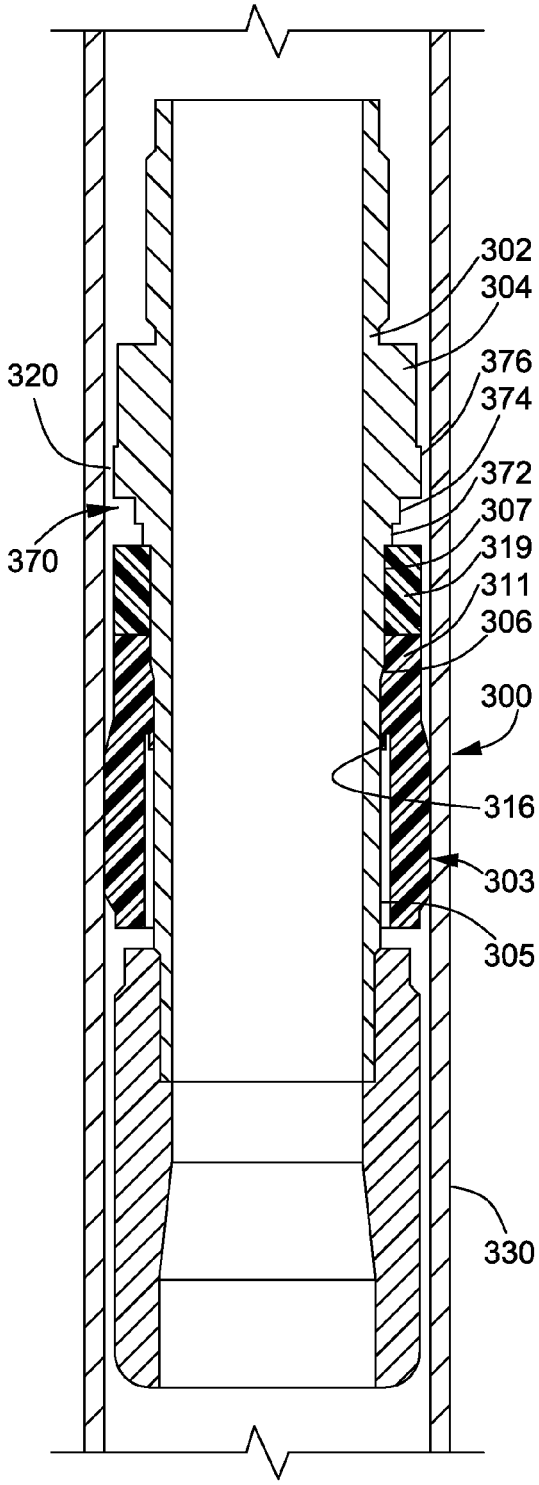
FIG. 15 is a schematic cross-sectional view of a cup tool in accordance with and eighth embodiment of the invention prior to setting the elastomeric cup.

FIG. 15 shows a cup tool 300 in accordance with yet another embodiment of the invention. The cup tool 300 has a cup tool tube 302 with an annular shoulder 304. Integrally formed with the annular shoulder 304 on the underside thereof is a plurality of square steps 370, which include a first step 372, a second step 374 and a third step 376. The first, second and third steps function in the same way as the gauge rings 340 described above.

Figure 16:
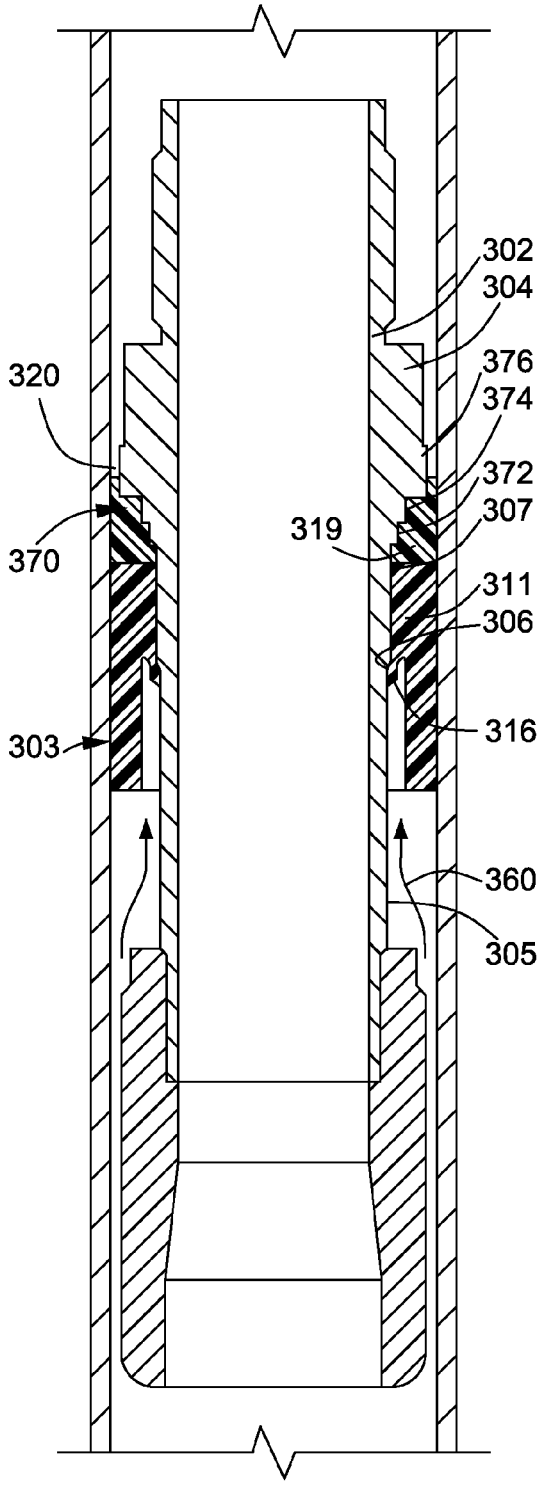
FIG. 16 is a schematic cross-sectional view of the embodiment shown in FIG. 15 subsequent to setting the elastomeric cup.

FIG. 16 shows the cup tool shown in FIG. 15 after the top part 319 of the two-part elastomeric cup 303 is set. If fluid pressure 360 in the well rises above a first threshold pressure, the top part 319 of the two-part elastomeric cup 303 extrudes over the first step 372. If the fluid pressure is elevated above a second threshold pressure, the top part 319 of the two-part elastomeric cup 303 extrudes over the second step 374. If the fluid pressure is further elevated above a third threshold pressure, the top part 319 of the two-part elastomeric cup 303 extrudes over the third step 376.

For certain operations, it may be desirable to install two cup tools 300 in a double cup tool configuration. In a double cup tool configuration, two cup tools are connected end-to-end, with a suitable adapter in between. The lower cup tool typically has a bullnose and acts as the primary seal while the upper cup tool connects to the high-pressure mandrel and acts as a backup seal to prevent fluid leakage if the primary seal fails. A double cup tool is disclosed is in Applicant's above-referenced United States patent.

The invention therefore provides a cup tool 300 with the two-part elastomeric cup 303 that is slidably received on a cup tool tube 302 without the necessity of bonding either part of the two-part elastomeric cup to metal. Accordingly, the cup tool 300 is simple and inexpensive to manufacture and maintain. Furthermore, the cup tool 300 has been successfully tested to fluid pressures exceeding 22,500 psi.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

We claim:

1. A cup tool for providing a high-pressure fluid-tight seal in an annular gap between the cup tool and a casing or a tubing in a cased wellbore, the cup tool comprising:

a cup tool tube having a threaded upper end for connection to a high-pressure mandrel, the cup tool tube having an outer surface over which a two-part elastomeric cup is slidably mounted for reciprocal movement from an unset position for entry of the cup tool into the casing or tubing to a set position in which the annular gap is obstructed by a top part of the two-part elastomeric cup to contain fluid pressure below the two-part elastomeric cup, the outer surface of the cup tool tube having a lower region of a first diameter and an upper region with a second, larger diameter and a tapered region between the upper region and the lower region; and the two-part elastomeric cup including a bottom part having a lip seal that rides against the outer surface of the cup tool tube, and seals against the tapered region of the cup tool tube to provide a high pressure seal between the cup tool tube and the bottom part of the two-part elastomeric cup when the two-part elastomeric cup is in the set position.

2. The cup tool as claimed in claim 1 further comprising a gauge ring located at a top end of the cup tool tube, the gauge ring inhibiting movement of the top part of the two-part elastomeric cup to the set position during entry of the cup tool into the well bore.

3. The cup tool as claimed in claim 2 wherein the gauge ring comprises at least two upward annular steps of increasing diameter to facilitate extrusion of the top part of the two-part elastomeric cup into the annular gap.

4. The cup tool as claimed in claim 3 wherein the upward annular steps are right angle steps in the gauge ring.

5. The cup tool as claimed in claim 1 further comprising a bullnose connected to a bottom of the cup tool tube for protecting the two-part elastomeric cup and guiding the cup tool through a wellhead.

6. The cup tool as claimed in claim 1 wherein the two-part elastomeric cup is made of polyurethane.

7. The cup tool as claimed in claim 6 wherein the bottom part and the top part of the two-part elastomeric cup each have a Durometer of 80-100.

8. A cup tool for providing a high-pressure fluid-tight seal in an annular gap between the cup tool and a tubing or casing in a cased wellbore, the cup tool comprising:

a cup tool tube having a threaded upper end for connection to a high-pressure mandrel, the cup tool tube having an outer surface over which a two-part elastomeric cup is slidably mounted for reciprocal movement from an unset position for entry of the cup tool into the wellbore to a set position in which the annular gap is obstructed by a top part of the two-part elastomeric cup to contain fluid pressure below the two-part elastomeric cup, the outer surface of the cup tool tube having a lower region of a first diameter and an upper region of a second, larger diameter and a tapered region between the upper region and the lower region; and a bottom part of the two-part elastomeric cup including a lip seal that rides against the outer surface of the cup tool tube and seals against the tapered region of the cup tool tube to provide a high pressure seal between the cup tool tube and the bottom part of the two-part elastomeric cup when the top part of the two-part elastomeric cup is in the set position.

9. The cup tool as claimed in claim 8 further comprising a gauge ring located at a top end of the cup tool tube, the gauge ring inhibiting movement of the top part of the two-part elastomeric cup to the set position during entry of the cup tool into the well bore.

10. The cup tool as claimed in claim 9 wherein the gauge ring comprises at least two upward annular steps of increasing diameter to facilitate extrusion of the top part of the two-part elastomeric cup into the annular gap.

11. The cup tool as claimed in claim 10 wherein the upward annular steps are right angle steps in the gauge ring.

12. The cup tool as claimed in claim 8 further comprising a bullnose connected to a bottom of the cup tool tube for protecting the two-part elastomeric cup and guiding the cup tool through a wellhead.

13. The cup tool as claimed in claim 8 wherein the bottom part and the top part of the two-part elastomeric cup are each made of polyurethane.

14. The cup tool as claimed in claim 13 wherein the bottom part and the top part of the two-part elastomeric cup each have a Durometer of 80-100.

15. A cup and a cup tool tube for a cup tool that provides a high-pressure fluid-tight seal in an annular gap between the cup tool and one of a cased wellbore and an inner wall of a tubing suspended in a cased wellbore, the cup and the cup tool tube comprising, in combination:

a hollow generally tubular two-part elastomeric cup body having an outer wall and an inner wall, the outer wall of a bottom part of the two-part elastomeric cup body extending downwardly past the inner wall and terminating on a bottom end in an annular depending skirt, and the inner wall of the bottom part including a lip seal that rides against an outer surface of the cup tool tube, and seals against a tapered region of the cup tool tube to provide a high pressure seal between the cup tool tube and the bottom part of the two-part elastomeric cup body when the two-part elastomeric cup body is in a set position in which a top part of the two-part elastomeric cup body seals the annular gap.

16. The combination as claimed in claim 15 wherein the bottom part and the top part of the two-part elastomeric cup body are each made of polyurethane.

17. The cup combination as claimed in claim 16 wherein the bottom part and the top part of the two-part elastomeric cup body each have a Durometer of 80-100.

18. A method of sealing an annular gap between a high pressure mandrel and a casing or a tubing in a cased wellbore in order to isolate pressure-sensitive wellhead components from high-pressure fracturing and stimulation operations in a well, the method comprising:

connecting a cup tool tube to a bottom end of the high-pressure mandrel, the cup tool tube having an outer surface over which a two-part elastomeric cup is slidably mounted for reciprocal movement from an unset position for entry of the cup tool into the wellbore to a set position in which the annular gap is obstructed by a top part of the two-part elastomeric cup to contain fluid pressure below the two-part elastomeric cup, the outer surface of the cup tool tube having a lower region of a first diameter and an upper region of a second, larger diameter and a tapered region between the upper region and the lower region;

sliding the top part and a bottom part of a two-part elastomeric cup over the cup tool tube, the bottom part including a lip seal that rides against the outer surface of the cup tool tube, and seals against the tapered region of the cup tool tube to provide a high pressure seal between the cup tool tube and the bottom part of the two-part elastomeric cup when the two-part elastomeric cup is in the set position;

connecting a bullnose to a bottom end of the cup tool tube;

inserting the cup tool into the casing or the tubing in the cased wellbore; and injecting high pressure fluids through the high pressure mandrel and the cup tool into the wellbore to force the two-part elastomeric cup upwardly and the top part against a shoulder at a top of the cup tool tube, thereby forcing the lip seal against the tapered region, while forcing the top part of the two-part elastomeric cup into the set position.

19. The method as claimed in claim 18 further comprising installing a gauge ring at a top end of the cup tool tube prior to sliding the top part and the bottom part of the two-part elastomeric cup over the cup tool tube.

20. The method as claimed in claim 19 further comprising, prior to connecting the bullnose, connecting another cup tool tube to a bottom end of the cup tool tube connected to the high pressure mandrel and repeating the step of sliding, followed by the steps of connecting, inserting and injecting.

* * * * *